United States Patent [19]

M'Sadoques et al.

[11] Patent Number: 4,778,961

[45] Date of Patent: Oct. 18, 1988

[54] COMPACT ELECTRIC SAFETY SWITCH

[75] Inventors: Andre J. M'Sadoques, Southington; Robert G. Markowski, East Haven, both of Conn.

[73] Assignee: General Electric Company, New York, N.Y.

[21] Appl. No.: 121,379

[22] Filed: Nov. 16, 1987

[51] Int. Cl.[4] ..... H01H 21/54

[52] U.S. Cl. ..... 200/17 R; 200/15; 200/330

[58] Field of Search ..... 200/17 R, 330; 361/331

[56] References Cited

U.S. PATENT DOCUMENTS 4,233,482 11/1980 DiMarco et al. ..... 200/163
4,352,964 10/1982 English ..... 200/16 D
4,675,481 6/1987 Markowski et al. ..... 200/144 R
4,675,782 6/1987 Hibbert et al. ..... 361/356

*Primary Examiner*—Roy N. Envall, Jr.
*Assistant Examiner*—Morris Ginsburg
*Attorney, Agent, or Firm*—Richard A. Menelly; Walter C. Bernkopf; Fred Jacob

[57] ABSTRACT

A compact electric safety switch including a rotatably mounted double contact blade assembly. Heavy duty compression springs are positioned under the blade assembly for rapid make and break connection between opposing line and load contact stabs. A pair of contact springs directs the contact blade during transit between the line and load contact stabs and serves to increase the contact pressure between the contact blade and the contact stabs when the contact blade is inserted therein.

13 Claims, 5 Drawing Sheets

10

COMPACT ELECTRIC SAFETY SWITCH

BACKGROUND OF THE INVENTION

The electrically insulative properties of thermally stable plastic materials multi-functionally houses and insulates the electrical components contained therein for electrical switching applications. The impact resistance of the plastic material facilitates mounting the movable components within the plastic enclosure without fear of damage caused by the violent arcs that occur when the switch contacts are connected and disconnected while carrying current. Suitable plastic materials for the switch enclosure are "Valox", a registered trademark of GE Company for polybutylene terepthalate and "Noryl", a trademark of GE Company for a modified polyphenylene oxide. One such molded plastic enclosure for electrical disconnect switches is described within U.S. Pat. No. 4,675,782 which is incorporated herein for reference purposes.

It is understood that electric arcs will form between a pa1r of electric contacts when the current through the contacts is interrupted and some arc chute means are required to cool and quench the electric arc. The larger the current during interruption, the more intense the arc and hence, the larger the arc chute required. The duration of the arc is related to the time involved in moving the electric contacts a sufficient distance such that the arc voltage necessary to maintain the arc is greater than the available systems voltage.

An early attempt to rapidly make and break electrical connection between a pair of separable contacts is found in U.S. Pat. No. 4,233,482, wherein the movable contact carrier engage an over-center spring to rapidly accelerate the opening and closing forces applied during manual operation of the movable contact carrier.

U.S. Pat. No. 4,675,481 entitled "Compact Electric Safety Switch" describes a safety switch that rapidly connects and disconnects between a pair of contacts with minimum arc formation. This Patent is incorporated herein for purposes of reference and should be reviewed for its teachings of an operating handle that is rotated to drive a pair of powerful operating springs to effect rapid contact interaction. The use of a rotating operating handle is somewhat limited both with respect to space requirements as well as to the right-handedness and left-handedness of potential operators. A right-handed operator would favor the arrangement of the operating handle on the right hand side of the switch, for example, whereas the left-handed operator would prefer the operating handle to be arranged on the left side of the switch. This often requires extra mounting hardware to be inventoried by the switch manufacture.

A slidably-operated handle operator readily solves both the limited space as well as left-handedness, right-handedness preference problems. One such switch employing a slidably arranged handle operator is described within U.S. patent application Ser. No. 026,496 filed Mar. 16, 1987 entitled "Fused Disconnect Switch with Non-Metallic Enclosure", which Application is incorporated herein for purposes of reference.

One purpose of the instant invention is to provide an electric switch that can be readily fitted with either a slidably-operated handle operator or with a rotatable left hand or right hand operator with a minimum requirement of inventoried parts.

DESCRIPTION OF THE PREFERRED EMBODIMENT

Figure 1:
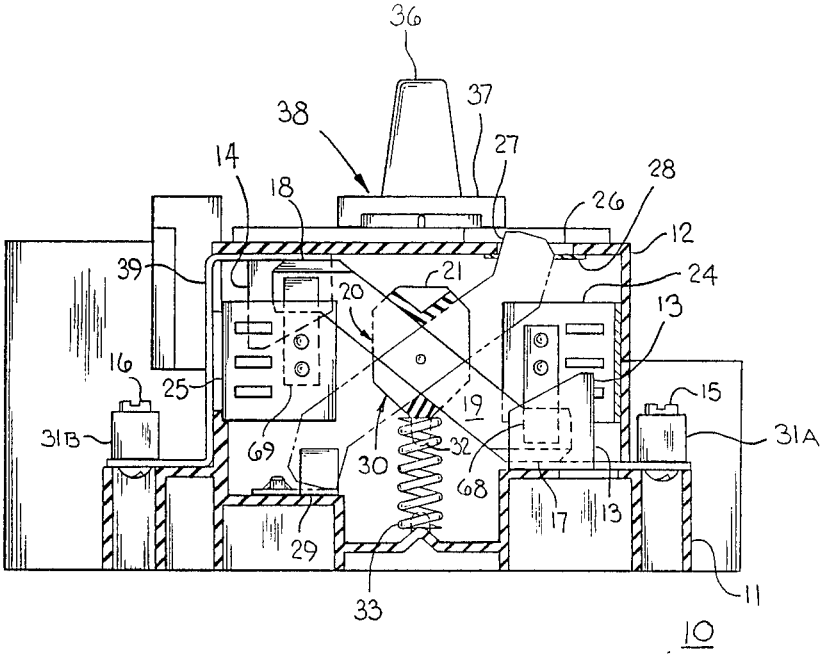
FIG. 1 is a side view in partial section of the electrical safety switch according to the invention.

An electrical disconnect or safety switch 10 is shown in FIG. 1 and consists of a molded plastic base 11 to which a molded plastic cover 12 is attached by means of rivets or screws (not shown). A line contact stab 13 and load contact stab 14 are attached to the cover and base respectively on opposite sides of a Z-shaped contact blade 19. The line stab is connected within an electrical distribution circuit by means of the line terminal screw 15 arranged on the line lug 31A and the load stab 14 is connected by means of the load terminal screw 16 arranged on the load lug 31B. The contact blade 19 which is formed into an offset line contact 17 at one end and an offset load contact 18 at an opposite end thereof is depicted in its "ON" position. The contact blade is carried by a rotor assembly. 20, which is pivotally arranged between the base and the cover and which includes a molded plastic split-cylinder 21, which is described in detail within the aferementioned U.S. Pat. No. 4,675,481. A unitary arc chute 24 is attached to the base adjacent the line stab 13 and a corresponding unitary arc chute 25 is attached to the cover adjacent the load stab 14, which is connected with the load lug 31B by means of the load strap 39 as indicated. The contact blade 19 is indicated in phantom in its "OPEN" position wherein the load contact extends through an indicating slot 26 formed in the top of the cover and contains an indicia coding 27 in the form of a high temperature paint to give positive indication to the operator that the contact has become separated. The contact blade 19 is guided during transition from its "ON" and "OFF" positions by means of a line contact spring 68 and a load contact spring 69 in a manner to be described below in greater detail. A healable pad 28 of a latex or soft plastic material such as polymerized polyvinyl alcohol or polyvinyl chloride is adhesibly attached to the inside flat surface of the cover to provide a dust free environment while allowing the line contact to pass through the indicating slot, as depicted. A retainer stab 29, attached to the bottom of base 11 receives and positions the load contact 18 when the line contact 17, in its open position, extends outside the cover. The split-cylinder 21 within the rotor assembly 20 includes a conical extension 30 integrally formed therein, which terminates at a stub or post 32 which supports the end of a compression spring 33. The handle operator 38 including an upwardly extending handle operator post 36, integrally formed on a handle operator support 37, is slidably arranged on a top surface of the cover 12 to control the operation of the rotor assembly 20 in a manner to be described below in greater detail.

Figure 2:
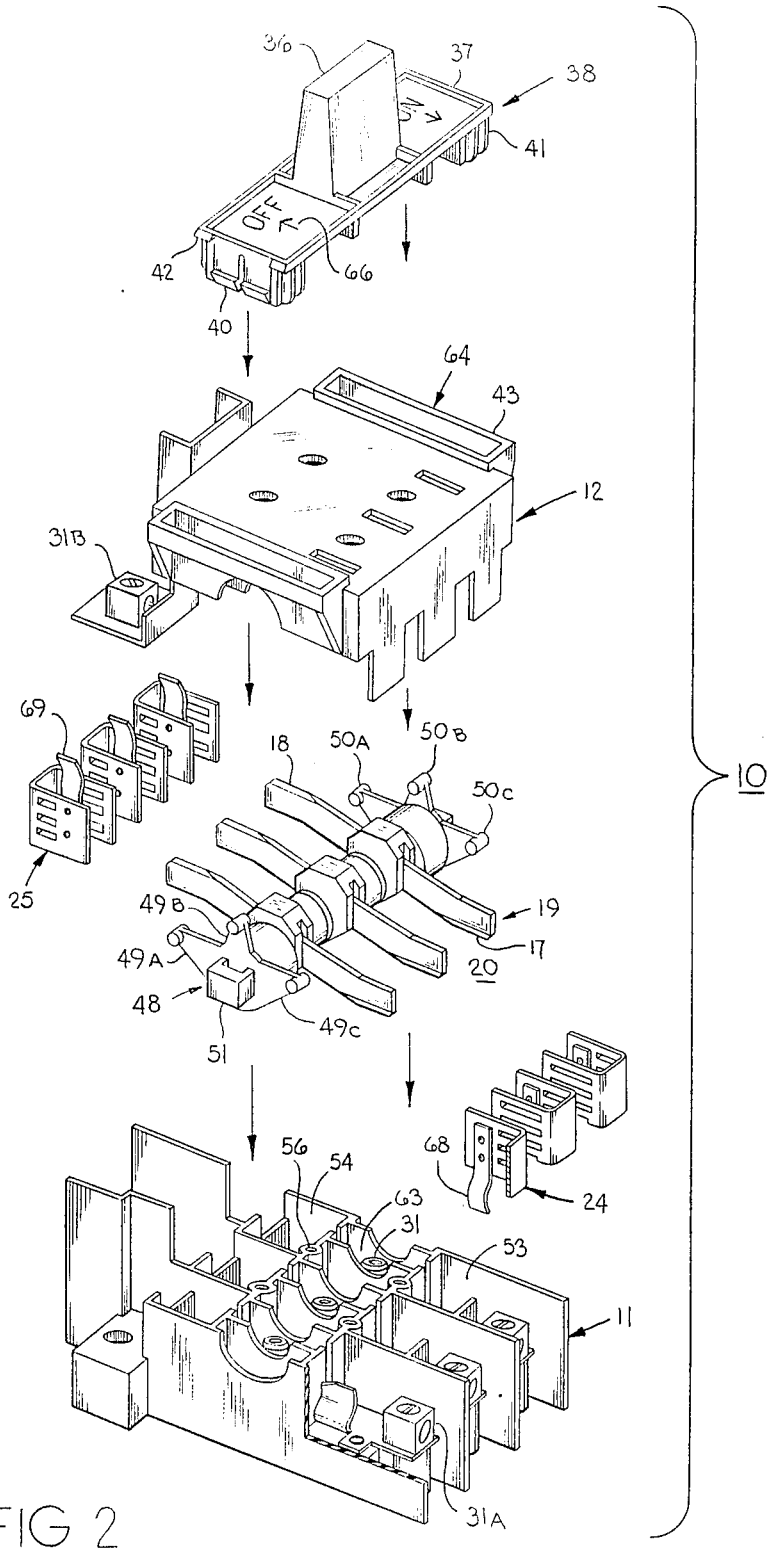
FIG. 2 is a top perspective view, in isometric projection, of the components within the electrical safety switch of FIG. 1.

The electric switch 10 is assembled in the manner depicted in FIG. 2 wherein the base 11, with the arc chute compartments 53, 54 and apertured mounting projections 56 integrally formed therein, is fitted with three powerful compression springs 31 within three central compartments 63 as indicated. The line contact spring 68 is attached to the bottom of each arc chute 24 and the load contact spring 69 is attached to the top of arc chute 25. The line and load lugs 31A, 31B are fastened to the base and the arc chutes 24, 25 are positioned in the base and cover respectively before the rotor assembly 20 is assembled on the base as fully described in aforementioned U.S. Pat. No. 4,675,481. The rotor assembly, with the exception of the rotor drive assembly 48, is arranged within the base in a similar manner as described in the Patent with contact blades 19 cooperating with the line and load contacts 17, 18. The plastic rotor drive assembly 48 includes three radially extending arms 49A–49C integrally formed therein and including corresponding posts 50A–50C. An integrally formed block 51 is provided at each opposite end of the rotor assembly to facilitate the implementation of a left-handed or right-handed operating handle (not shown) that is similar to that employed within the latter referenced Patent. The cover 12 includes a pair of elongated rectangular platforms 64 formed on each side thereof which define a pair of upstanding rails 43. The handle operator 38, fits over the cover 12 with the integrally formed downward planar projections 41, received within the elongated rectangular platforms 64 on the base. Detents 42 integrally formed on the two outermost projections ride on the top surface of the rails 43 while the protruding tabs 40 integrally formed on the bottom of the inboard pair of projections ride along the bottom surface of the rails. As described earlier, the handle operator 38 includes in upwardly extending handle operator post 36 integrally formed on the handle operator support 37 from which the projections 41 downwardly depend. "ON" and "OFF" indicia, along with indicating. arrows, are defined at 66 on the handle operator support 37 on opposite sides of the handle operator post 36.

Figure 3:
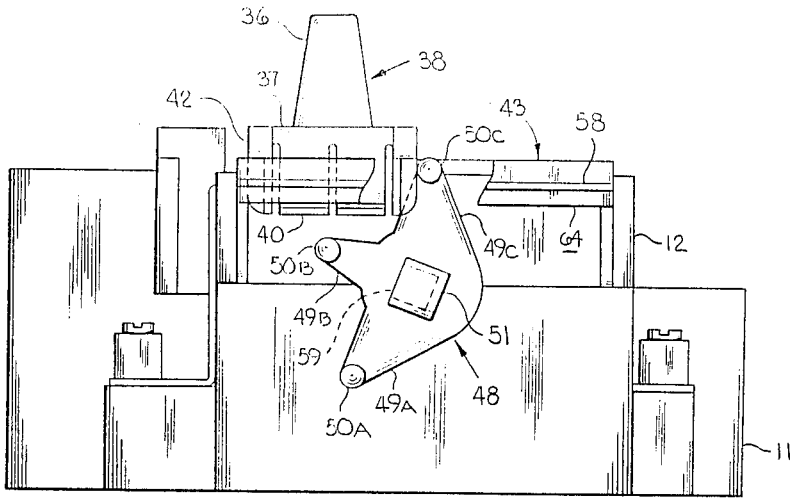
FIG. 3 is a side view of the rotor drive assembly within the electrical safety switch of FIG. 1.

The rotor drive assembly 48 is best seen by referring now to FIG. 3 wherein the switch 10 is depicted with the cover 12, positioned on the base 11 and with the rotary drive assembly in operative association with the handle operator 38. The optional rotary mounted operating handle described earlier can be positioned within a pocket 59 formed within the block 51 that protrudes outwards from the rotor drive assembly 48 to accommodate a left-handed or right-handed operator preference. A reinforcing bar 58 is formed on the exterior surface of the platforms 64 to prevent the rails 43 from flexing when the handle operator 38 is brought into contact with the rotor drive assembly 48. The detects 42 on the top of the rails and the protruding tabs 40 on the bottom thereof guide the handle operator post 36 and handle operator support 37 integrally formed on the handle operator 38 as (they slide along the rails 43 into contact with the posts 50A–50C that are integrally formed on the ends of the respective arms 49A–49C.

Figure 4A:
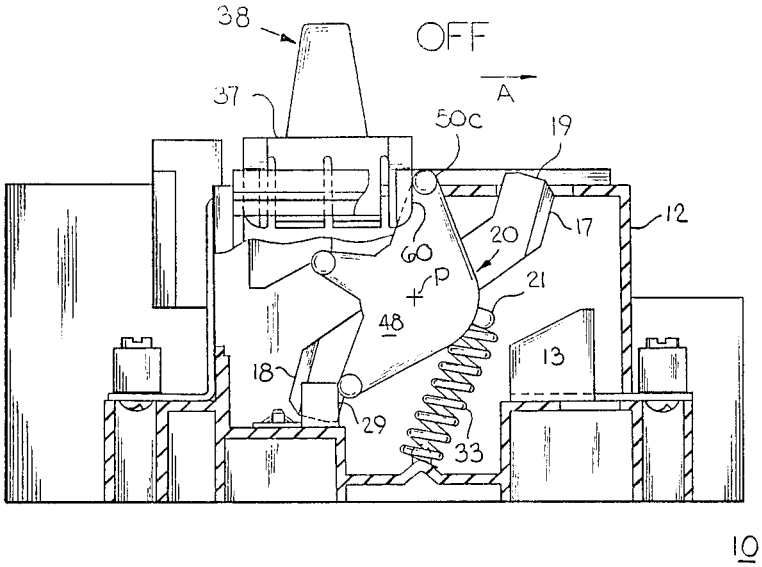
FIGS. 4A–4C are side views, in partial section, of the rotor drive assembly of FIG. 3 illustrating the contact blade progressing from the "ON" to "OFF" position.
Figure 4B:
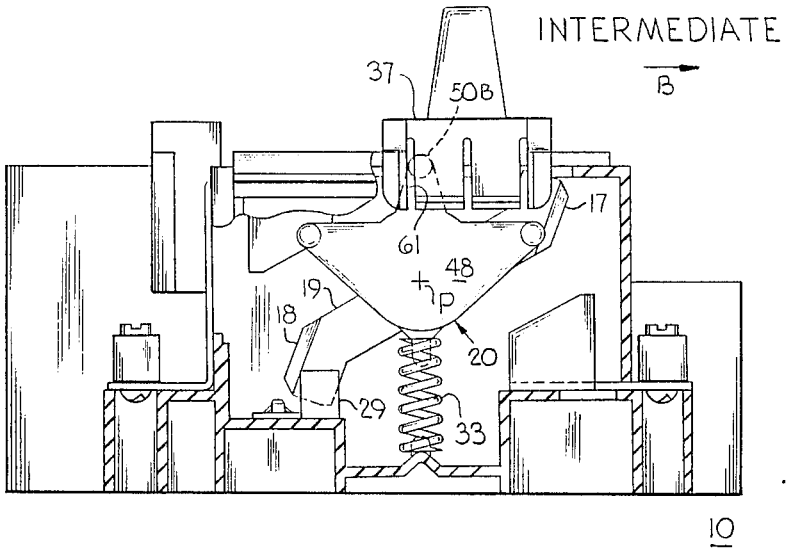
Figure 4C:
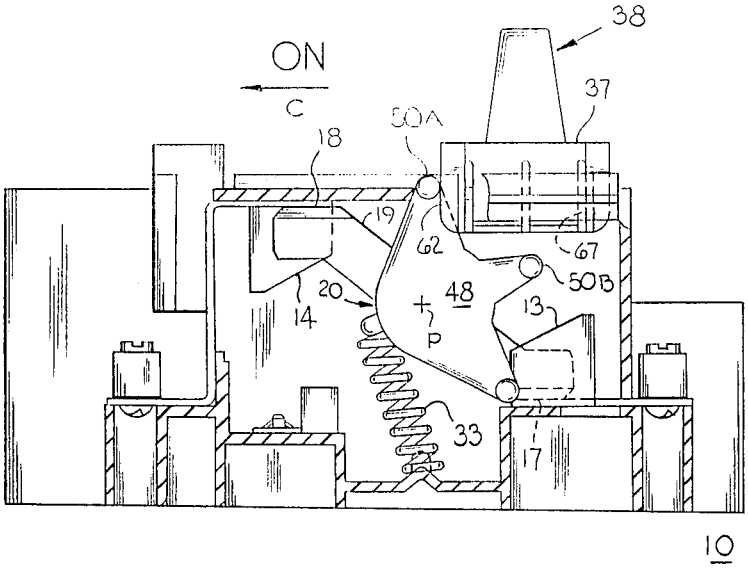

The interaction between the handle operator 38 and the rotor drive assembly 48 is best seen by referring now to FIGS. 4A–4C. In FIG. 4A, the switch 10 is depicted in its "OFF" position such that the line contact 17 at one end of the contact blade 19 is out of the line stab 13 and the load contact 18 at the opposite end of the contact blade 19 is held within the retainer stab 29. In this position the handle operator 38 is at the left-most corner of the cover 12 and the split-cylinder 21 within the rotor assembly 20 is to the left of its operating pivot "P" with the operating spring 33 fully extended to the right side of the operating pivot. To transfer the switch from its "OFF" position to the "INTERMEDIATE" position depicted in FIG. 4B, the handle operator 38 is moved in the direction indicated by arrow "A" such that the exterior forward surface 60 of the handle operator support 37 strikes post 50C on the rotor drive assembly 48. The rotor drive assembly 48 then rapidly drives the rotor assembly 20 in the indicated clockwise direction such that the rear interior surface 61 of the handle operator support 37 now strikes post 50B on the rotor drive assembly 48 thereby rotating the contact blade 19 and attached load contact 18 out of the retainer stab 29 and bringing the operating spring 33 to its center position with respect to the operating pivot "P". Continuing the sliding motion of the handle operator 38 in the direction indicated by arrow "B" rapidly drives the operating spring 33 to the left of the operating pivot "P" to correspondingly drive the contact blade 19 in the clockwise direction. The load contact 18 is in turn rapidly driven into the load stab 14 while the line contact 17 is simultaneously driven into the line stab 13 as ind1cated in the "ON" condition depicted in FIG. 4C. To turn the switch from its "ON" to its "OFF" positions, the procedure is reversed whereby movement of the handle operator 38 in the direction indicated by arrow "C" brings the exterior rear surface 62 of the handle operator support 37 against post 50A on the rotor drive assembly 48. Further sliding motion in the indicated direction would then drive the interior forward surface 67 of the handle operator support 37 against post 50B to drive the rotor assembly 20 to the over-center of the operating pivot "P" to return to the "OFF" condition depicted in FIG. 4A.

Figure 5A:
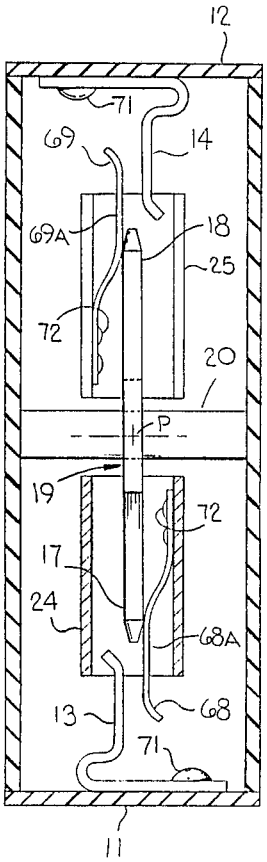
FIGS. 5A–5C are end views of the contact blade of FIG. 1 progressing into the "ON" position.
Figure 5B:
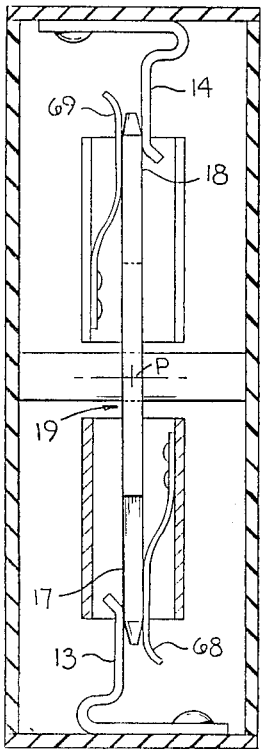
Figure 5C:
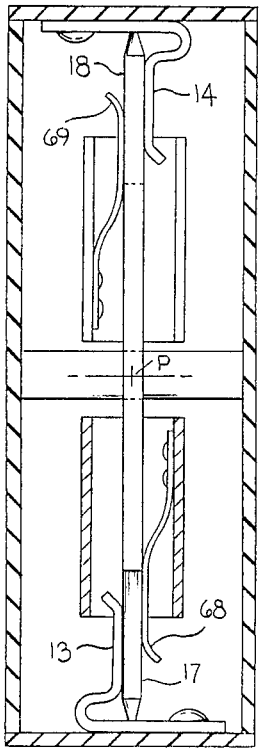

The function of the line contact spring 68 and load contact spring 69 shown earlier in FIG. 1 attached to the arc chutes 24, 25 respectively can best be seen by referring now to FIGS. 5A–5C. For purposes of clarity, the rotor drive mechanism 48 and handle operator 38 are removed and the rotor assembly 20 is simply shown extending between both sides of the base 11 and the cover 12. The line stab 13 made of copper, or a copper alloy, is shown attached to the base 11 by means of a stud 71 and is positioned within the arc chute 24 to which the line contact spring 68 made of a spring steel alloy is attached by means of a coined projection 72. The load stab 14 made of the same material as the line stab is attached to the cover 12 by means of a stud 71. The load contact spring 69 made of the same material on the line contact spring is attached to the arc chute 25 by means of the projection 72. The arms 68A, 69A of the line and load contact springs 68, 69 are cantilevered outward from the inner surface of their respective arc chutes, in opposite directions from each other. Besides providing contact spring facility, whereby the load contact spring 69 forces the load contact 18 into good electrical connection with the load stab 14 and the line contact spring 68 forces the line contact 17 into good electrical connection with line stab 13, the line and load contact springs also serve to guide the contact blade 19 during rotation. In FIG. 5A, for example, the contact blade 19 is shown immediately prior to insertion of the line and load contacts 17, 18 within their respective line and load stabs 13, 14. The line load contacts first strike against their corresponding line and load contact springs 68, 69 to take up any slack occurring between the contact blade 19 and the rotor assembly 20 and thereby eliminate any wobble that might otherwise occur. In FIG. 5B, the line contact 17 now abuts both the line stab 13 as well as the line contact spring 68 while the load contact 18 simultaneously abuts both the load stab 14 and the load contact spring 69. In this position the contact blade 19 experiences a torque in the plane of the page about the pivot "p" defined by the point of contact between the contact blade 19 and the rotor assembly 20. The torque exerted by the line contact spring 68 forces the load contact at the opposite end of the contact blade 19 against the load stab 14 while the torque exerted by the load contact spring 69 forces the line contact 17 at the opposite end of the contact blade 19 against the line stab 13. Continued movement of the contact blade 19 forms the line and load contacts 17, 18 further within their respective line and load stabs 13, 14 to the final position depicted in FIG. 5C. The positioning of the line and load contact spring arms 68A, 69A in opposite directions, multi-functionally applies increased contact force between the respective contacts and contact stabs both directly as well as by means of the torque exerted upon the opposite contacts as described earlier. The increased contact force helps to lower the contact resistance between the contacts and their respective stabs over long periods of continuous usage and maintain a low contact resistance by removing any oxides that may form therebetween.

An electric switch has herein been described having a rotor drive assembly that rapidly drives the switch contact blade and line and load contacts into simultaneous connection with their respective line and load stabs. Especially oriented contact springs substantially increase the forces applied between the line and load contacts and their respective line and load stabs.

Having thus described my invention, what I claim as new and desire to secure by Letters Patent is:

1. An electric switch comprising:

an enclosure;

a rotatable switch contact blade within said enclosure;

a line contact stab and a load contact stab arranged at opposing ends of said contact blade providing electric connection between corresponding line and load terminals, biased for rotation by an operating spring;

a rotor carrying said contact blade and arranged for rotating said contact blade between said line and said load contact stabs; and a drive assembly on said enclosure interfacing between said rotor and a handle operator, said drive assembly comprising a plurality of arms projecting outwardly from said rotor and terminating in a corresponding plurality of posts;

said handle operator including a slidably mounted support and an operator post member arranged to contact said posts and rotate said rotor and said contact blade in response to movement of said operator post.

2. The electric switch of claim 1 including a plurality of projections depending from said support, said projections being slidably arranged on a pair of platforms on opposite sides of enclosure.

3. The electric switch of claim 2, including detents formed on said projections overhanging a respective rail on said platforms to guide said support along said rail.

4. The electric switch of claim 3 including tabs underlying said rail to further guide said support along said rail.

5. The electric switch of claim 1 wherein said drive asssembly comprises an arcuate plate attached to an end of said rotor.

6. The electric switch of claim 5 wherein said posts are integrally-formed with said arcuate plate.

7. The electric switch of claim 6 further including a rectangular projection integrally-formed on said arcuate plate and including a pocket formed within said rectangular projection for receiving an optional operator handle.

8. The electric switch of claim 1 including a first arc chute associated with said line stab and a second are chute associated with said load stab.

9. The electric switch of claim 8 including a line contact spring attached to said first arc chute and a load contact spring attached to said second arc chute.

10. The electric switch of claim 9 wherein said line and load contact springs are cantilevered away from said contact blade whereby said contact blade experiences a torque force on opposite ends thereof directing said ends into contact relation witn said line and load stabs.

11. The electric switch of claim 10 wherein said line and load contact springs directly force said ends into contact with said line and load contact stabs.

12. The electric switch of claim 11 wherein said line and load contact stabs are attached to corresponding line and load straps.

13. The electric switch of claim 12 wherein said line and load contact stabs, are cantilevered toward said ends.

* * * * *